US005466291A

United States Patent [19]

DiRico

[11] Patent Number: 5,466,291

[45] Date of Patent: Nov. 14, 1995

[54] STAND ALONE COATING APPARATUS FOR PRINTED MATERIAL AND METHOD OF OPERATION THEREOF

[75] Inventor: Mark A. DiRico, Quincy, Mass.

[73] Assignee: MMT Manufacturing Corp., Marietta, Ga.

[21] Appl. No.: 175,273

[22] Filed: Dec. 29, 1993

[51] Int. Cl.[6] ..... B05C 1/08

[52] U.S. Cl. ..... 118/244; 118/58; 118/70; 118/203; 118/239; 118/249; 118/262; 118/642; 427/395; 427/428

[58] Field of Search ..... 118/58, 70, 203, 118/642, 239, 244, 246, 249, 262, 104; 427/428, 395; 101/424.2, 424.1, 488

[56] References Cited

U.S. PATENT DOCUMENTS

| | | | |
|---|---|---|---|
| 2,649,758 | 8/1953 | Cowgill | 118/602 |
| 2,904,349 | 9/1937 | Carlson | 91/50 |
| 3,559,572 | 2/1971 | Hackley | 118/262 |
| 3,811,821 | 5/1974 | Ariyama et al. | 118/70 |
| 3,861,351 | 1/1975 | Bonwit et al. | 118/262 |
| 4,029,833 | 6/1977 | Kosta | 427/428 |
| 4,203,585 | 5/1980 | Kunz et al. | 217/4 |
| 4,270,483 | 6/1981 | Butler et al. | 118/206 |
| 4,369,961 | 1/1983 | Gopel et al. | 271/10 |
| 4,446,814 | 5/1984 | Abendroth et al. | 118/262 |
| 4,503,802 | 3/1985 | Keller et al. | 118/249 |
| 4,509,454 | 4/1985 | Vertegaal | 118/681 |
| 4,522,385 | 6/1985 | Stefansson | 271/10 |
| 4,569,306 | 2/1986 | Ito et al. | 118/249 |
| 4,569,864 | 2/1986 | McIntyre | 427/428 |
| 4,615,295 | 10/1986 | Wittkopf | 118/261 |
| 4,685,414 | 8/1987 | DiRico | 118/46 |
| 4,703,715 | 11/1987 | Scheffer | 118/203 |
| 4,704,296 | 11/1987 | Leanna et al. | 427/428 |
| 4,796,556 | 1/1989 | Bird | 118/262 |
| 4,815,413 | 3/1989 | Kota | 118/46 |
| 4,825,804 | 5/1989 | Dirico et al. | 118/46 |
| 4,928,623 | 5/1990 | Kojima | 118/249 |
| 4,934,305 | 6/1990 | Koehler et al. | 116/46 |
| 4,949,667 | 8/1990 | Yoshida et al. | 118/60 |
| 5,002,007 | 3/1991 | Jahn | 118/46 |
| 5,028,457 | 7/1991 | Kinose et al. | 427/258 |
| 5,048,453 | 9/1991 | Eriksson | 118/246 |
| 5,107,790 | 4/1992 | Sliker et al. | 118/674 |
| 5,160,399 | 11/1992 | Ueda et al. | 118/642 |
| 5,275,663 | 1/1994 | Kirn et al. | 118/641 |

FOREIGN PATENT DOCUMENTS

| | | | |
|---|---|---|---|
| 2135934 | 9/1984 | United Kingdom | 427/428 |
| 2228216 | 8/1990 | United Kingdom | 118/262 |
| 8701308 | 8/1986 | WIPO . | |

*Primary Examiner*—W. Gary Jones
*Assistant Examiner*—Laura E. Edwards
*Attorney, Agent, or Firm*—Antonelli, Terry, Stout & Kraus

[57] ABSTRACT

A stand alone printing system (10) for coating a first face of sheets on which printing may be printed previously by a printer not associated with the system includes a feeding mechanism (14), a driven application roller (76) for transferring coating material disposed on the peripheral surface (77) to the first face; a metering device (78) for transferring a uniform thickness of coating material to the peripheral surface of the application roller; a driven impression roller (85) which contacts a second face of the sheets and which contacts the peripheral surface of the application roller at least at gaps disposed between the sheets during feeding of the sheets along the coating zone which transfers the coating material to the peripheral surface (86) of the impression roller; and a coating material removing mechanism (116) for removing coating material from the peripheral surface of the impression roller prior to rotation of the peripheral surface of the impression roller to a point of contact with the second face of the sheets to prevent the transfer of the coating material to the second face of the sheets.

20 Claims, 4 Drawing Sheets

STAND ALONE COATING APPARATUS FOR PRINTED MATERIAL AND METHOD OF OPERATION THEREOF

TECHNICAL FIELD

The present invention relates to an apparatus for coating a first face of sheets of material on which printing may be printed previously by a printer not associated with the coating system and a method of operation thereof. The printing system which printed material on the first face of the sheets to be coated may be a standard offset lithographic printing press.

BACKGROUND ART

In offset lithographic printing, each printing stage includes a plate cylinder, to which the printing plates are fastened tightly around the circumference. The plate cylinder is equipped with superimposed inking, watering and wiping mechanisms. The plate cylinder does not come into contact with the sheets of material to be printed. Instead, the plate cylinder transfers the image to an intermediate blanket cylinder which has a specially composed smooth rubber blanket surface. During operation, the blanket cylinder is packed with a sheet having a cross-sectional area slightly longer and wider than the sheets to be printed which is disposed between an underlying steel cylinder and the rubber surface coating to lift the rubber surface which is to receive the impression from the printing plate slightly radially outward from portions of the rubber surface which are not packed. The blanket cylinder receives the impression from the plate cylinder and transfers it or offsets it onto the sheets to be printed while being carried around the blanket cylinder located out of contact with the plate cylinder.

In many applications it is desirable to apply a coating to a printed sheet. For example, a water soluble polymer finish may be applied to a work piece printed by offset lithography to "dry" the sheet quickly by coating the surface while it is still tacky. This coating method avoids the need for powder driers that may be cumbersome or air drying procedures which may be slow. Furthermore, coatings are also useful for providing a glossy finish that improves the rub resistance of the coated sheet and improves its overall appearance. Finally, adhesive coatings may be applied to printed packaging. Heat set adhesives may be applied to enable attachment of a feature such as the clear plastic bubble of a package used to display the product.

Application of coatings to a work piece is made difficult by various requirements. For example, the coating should be uniform and its thickness should be controlled. Moreover, the coatings should be applied quickly, before its vehicle evaporates causing it to thicken. In many applications it is desirable to apply an overall coating to the printed sheet. For example, a UV curable or water-soluble polymer finish may be applied to a workpiece printed by offset lithography. The coating on the sheet is quickly dried while the surface of the ink is still tacky.

Printing presses conventionally have a liquid trough and train of smooth surface transfer rollers located above the blanket cylinder and the plate cylinder for supplying of other liquids such as varnishes to the printed sheet via the blanket cylinder.

Furthermore, add-on coating units have been developed which are attached to the last printing station of a lithographic press for selective positioning with the blanket cylinder which during normal printing transfers the image of the material to be printed under pressure at a nip produced by an impression cylinder. A supply of coating material is transferred from a metering station which may be an engraved roller contacting the trough of material and a doctor blade which produces a uniform coating on the engraved roller as it rotates past the doctor blade for contact with the blanket cylinder. The add-on units operate under the principle of selective positioning of a coating material metering device in contact with the blanket cylinder to transfer the coating material to the blanket cylinder to permit coating when sheets are run through the nip between the blanket cylinder and impression cylinder or withdrawal so that the last printing station may be used in its conventional manner for printing.

U.S. Pat. Nos. 4,270,483, 4,685,414, 4,825,804, 4,934,305 and 5,107,790 describe systems for applying coating materials used in conjunction with lithographic printers. U.S. Pat. Nos. 4,685,414 and 4,825,804 are incorporated by reference herein in their entirety. Each of the coating systems described in the aforementioned patents is operated in conjunction with a lithographic printing press of standard design. These systems, while successfully performing coating of printed sheets either in their entirety or in spot applications, suffer from the disadvantage of being of substantial cost because of the requirement to be added on to an offset printing system which itself is a very expensive device. Costs for add-on coating systems may exceed $100,000.

U.S. Pat. No. 4,270,483 discloses the transfer of coating material from a pickup roller to an application roller which in turn transfers the coating material to a blanket cylinder. Coating is performed when the top face of the sheet to be coated passes between the impression roller and the blanket cylinder which are opposed to each other to form a nip.

U.S. Pat. No. 4,685,414 discloses the transfer of coating material from the engraved surface of a roller which meters coating material by providing a continuous excessive flow of coating material between a doctor blade and the engraved surface of the roller which is metered by the engraved surface and doctor blade to produce a uniform coating on the surface of the engraved roller which contacts a blanket roller. The blanket roller in turn contacts an impression roller to form a nip between which the sheets to be coated. Rolling contact of the blanket roller on the first face of the sheets to be coated transfers a uniform thickness of coating material to the sheets as they pass the nip between the blanket cylinder and the impression roller.

U.S. Pat. No. 4,825,804 discloses an add-on coating system in accordance with the '414 patent which facilitates the ability of the final press unit to perform both printing and coating functions. The mounting assembly enables the operator to disengage the coating assembly and move it away from the final press unit both horizontally and vertically so that the unit may be used as a conventional lithographic press unit.

U.S. Pat. No. 4,934,305 discloses an add-on coating system which utilizes a transfer roller to which is fed coating material which is metered to produce a uniform thickness for transfer to a blanket cylinder. Rolling contact between the blanket cylinder and an impression roller transfers coating material coated on the top surface of the blanket cylinder to a first face of sheets to be coated as they pass between a nip between the blanket cylinder and the impression roller.

U.S. Pat. No. 5,107,790 discloses a coating system which permits coating rollers to be moved into contact with the plate cylinder and blanket cylinder of a conventional printing unit and to be withdrawn to accessible positions for cleaning when not in use. Coating material is applied from a coating roller to a pickup roller which is coated with a material such as lacquer. The pickup roller is positioned in a withdrawn position from contact with the plate cylinder to permit spot cleaning and positioned in surface contact with the plate cylinder during operation. The coating rollers have a larger diameter which reduces the tendency of the rollers to sling coating material off the surface by centrifugal force. The coating material is in turn transferred from the blanket cylinder to a first surface of a sheet to be coated which passes between a nip formed between the blanket cylinder and the impression roller.

An in-line coater is sold by Norton Burdette Company of Nashua, N.H., which has a single roller driven directly by a D.C. motor. The roller is a gravure cylinder that transfers coating to a standard press unit blanket cylinder. The coater is attached to a pivoting arm and the unit is pivoted away from the press unit when the coater is not in use.

An in-line coater is sold by IVT Color Dry Ink of Fairfield, Conn., which applies coating from a reservoir pan to a standard press unit blanket cylinder using a pickup roller that delivers the coating material supplied to a metering device roller. The metering device roller applies the coating to the blanket cylinder of a press unit.

Each of the aforementioned coating systems utilizes the blanket cylinder to transfer coating material to the face of the sheets to be coated with the coating material being applied to the blanket cylinder surface from a metering device. The coating material is transferred from the raised surface of the blanket cylinder, produced by the aforementioned packing the blanket cylinder, to a first face of the sheet to be coated as the sheets pass between a nip of the packed blanket cylinder and the impression roller. As a result of the packing of the blanket cylinder with the underlying sheet, contact with the metering device only coats the raised surface of the blanket roller. Systems which apply coating material to a first face of sheets from a coated portion of the cross-sectional area of a blanket cylinder which is raised with respect to the remainder of the cross-sectional area of the blanket cylinder do not have a problem of transferring coating material to the second face of the sheets as a result of contact of the blanket cylinder with the impression rollers at gaps at least between the sheets. However, as has been stated above with respect to the cost of add-on systems, they are extremely expensive because of their design requiring accommodation with the existing expensive parts of the last printing station of a lithographic offset printing system.

DISCLOSURE OF THE INVENTION

The present invention is a stand alone coating system for coating a first face of sheets on which printing may be printed previously by a printing press not associated with the coating system and method of operation thereof. The invention provides a coating system which is less expensive than the prior art systems described above which are typically limited to being used as part of expensive lithographic printing systems. With the invention, coating is performed by a stand alone unit without the requirement of a mounting geometry producing surface contact between a metering device and a blanket cylinder. In a preferred form of the invention, coating material is transferred from a metering device to a driven application roller which contacts a first face of sheets, on which printing may be printed previously by a printer which are to be coated, which pass between a nip between the driven application roller and a driven impression roller. Coating material also is undesirably transferred from the driven application roller to the peripheral surface of a driven impression roller at least at gaps disposed between the sheets during feeding of the sheets along a coating zone. A coating material removing mechanism is necessary to remove any coating material transferred from rolling contact between the peripheral surface of driven application roller and the peripheral surface of the driven impression roller at least at gaps disposed between the sheets and additionally from the portion of the driven application roller which is not covered by the outside periphery of the sheets to be coated during rolling between the nip between the driven application roller and the driven impression roller. The metering device may be a metering device roller and a doctor blade which has an edge facing a peripheral surface of the metering device roller with a spacing between the edge and the peripheral surface of the metering device roller set to a distance equal to the uniform thickness of coating applied to the peripheral surface of the metering device roller contained in a dam of coating material disposed between the edge and the peripheral surface of the metering device roller during rotation of the roller. The doctor blade may be adjustable to vary the setting of the uniform thickness and the metering device roller may be engraved to retain coating material on the surface thereof.

A coating material recirculation system is provided having a first pan disposed below the metering device roller for catching any coating material flowing from the metering device during coating of the first surface of the sheets. A second pan is disposed below the coating material removing mechanism for catching any coating material flowing from the impression roller and the coating material removing mechanism. A drain drains coating material collecting in the first pan into the second pan. A flow path connects a drain in the second pan to the metering device roller. At least one pump is provided for pumping the coating material through the flow path from the drain of the second pan to the metering device.

A feeder is disposed at an infeed position of the coating zone for feeding individual sheets from a bottom of a stack of sheets to be coated to the coating zone. The feeder has a first driven belt with a top surface which contacts the second face of the sheets after the sheets are fed from the bottom of the stack. The first driven belt conveys the sheets toward and past the application roller and impression roller. Furthermore, an ultraviolet curing station is located at the outfeed position of the coating zone for curing an ultraviolet curable coating material coated on the first face of the sheets by the application roller as the sheets are conveyed through the curing station by a second driven belt. The ultraviolet curing station, as a consequence of during generation of ultraviolet light also generating substantial infrared radiation, may be used to cure both aqueous-based coatings and coatings which require ultraviolet light to complete the curing process.

The application roller is cylindrical and the peripheral surface of the application roller contacts the first face of the sheets or at least the gaps between the sheets continually during coating of the first face of the sheets. Furthermore, because of the application roller typically being wider than the width of the sheets, the application roller will contact the impression roller around the entire periphery of the sheets as they roll between the nip between the application roller and impression roller.

A preferred orientation of the metering device is with a driven metering device roller, which faces the peripheral surface of the application roller, disposed closer to the infeed position than an axis of rotation of the application roller. This orientation causes a dam of coating material to form at opposed peripheral surfaces of the driven metering device roller and the application roller when the driven metering device roller and application roller are rotating in opposite directions which conveys the coating material toward the infield feed position during coating of the first face of the sheet. The dam of coating material is preferably located at an angular position between 30° and 60° measured from a vertical line passing through the impression roller axis and a line passing through the impression roller axis and the dam. If the metering device roller axis is disposed farther from the infield position than an axis of rotation of the application roller, the dam of coating material will form at a position which can cause the coating material to flow from the dam over the face of the application roller which can lead to undesirable spillage onto the sheets or to the associated parts of the coating system disposed below the dam. As a result, the preferred orientation of the axis of rotation of the driven metering device roller is disposed closer to the infield position than the axis of rotation of the application roller.

A method of coating a first face of sheets on which printing may be printed previously by a printer utilizes the above-described apparatus including the metering device roller, application roller and impression roller. The method does not require apparatus as expensive as the prior art apparatus.

A stand alone coating system for coating a first face of sheets on which printing may be printed previously by a printer and not associated with the coating system in accordance with the invention includes a feeding mechanism for feeding the sheets to be coated from an infeed position to a coating zone at which the sheets are coated to an outfeed position; a driven application roller, disposed within the coating zone and having a peripheral surface which contacts the first face of the sheets fed along the coating zone, for transferring the coating material disposed on the peripheral surface to the first face; a metering device, disposed within the coating zone and facing a peripheral surface of the application roller, for transferring a uniform thickness of coating material to the peripheral surface of the application roller; a driven impression roller, disposed within the coating zone and having a peripheral surface opposed to the peripheral surface of the application roller, which contacts a second face of the sheets opposed to the first face and which contacts the peripheral surface of the application roller at least at gaps disposed between the sheets during feeding of the sheets along the coating zone which transfers the coating material to the peripheral surface of the impression roller; and a coating material removing mechanism, contacting the peripheral surface of the impression roller, for removing coating material from the peripheral surface of the impression roller to prevent transfer of the coating material to the second face of the sheets. The metering device may comprise a metering device roller and a doctor blade which has an edge facing a peripheral surface of the metering device roller with a spacing between the edge and the peripheral surface of the metering device roller set to a distance equal to the uniform thickness of coating material applied to the peripheral surface of the metering device roller from a dam of coating material disposed between the edge and the peripheral surface of the metering device roller during rotation of the metering device roller; and wherein the peripheral surface of the metering device roller transfers the uniform thickness of coating material to the peripheral surface of the application roller. The doctor blade may be adjustable to vary the setting of the uniform thickness. The metering device roller may be engraved to retain coating material on the surface thereof. The peripheral surface of the metering device roller deforms during coating of the sheets and the peripheral surface of the impression roller does not deform during coating of the sheets or, alternatively, the peripheral surface of the application roller does not deform during coating of the sheets and the peripheral surface of the impression roller deforms during coating of the sheets. The deformable application roller, or impression roller, may be a metallic roller with a rubber coating.

A coating material recirculation system is provided having a first pan disposed below the metering device roller for catching any coating material flowing from the metering device roller during coating of the first surface of the sheets. A second pan is disposed below the coating material removing mechanism for catching any coating material flowing from the impression roller and the coating material removing mechanism. A drain drains coating material collecting in the first pan into the second pan. A flow path connects a drain in the second pan to the metering device roller. At least one pump pumps the coating material through the flow path from the drain of the second pan to the metering device roller.

A feeder is disposed at the infeed position for feeding individual sheets from a bottom of a stack of sheets to be coated to the coating zone with the feeder having a first driven belt with a top surface which contacts the second face of the sheets after the sheets are fed from the bottom of the stack and which conveys the sheets toward and past the application roller and impression roller. Furthermore, an ultraviolet curing station may be disposed at the outfeed position for curing a curable coating material coated on the first face of the sheets by the application roller as the sheets are conveyed through the curing station by a second driven belt.

The application roller is cylindrical and the peripheral surface of the application roller contacts the first face of the sheets or at least the gaps continually during coating of the first face of the sheets. When the application roller is wider than the sheets being coated, the application roller also contacts the impression roller outside the periphery of the sheets as they pass between the nip of the application roller and the impression roller.

In a preferred embodiment of the invention, an axis of rotation of the driven metering device roller of the metering device is disposed closer to the infeed position than an axis of rotation of the application roller causing a dam of coating material to form at opposed peripheral surfaces of the driven metering device roller and the application roller when the driven metering device roller and application roller are rotating in opposite directions which conveys the coating material toward the infeed position. The dam of coating material is preferably located at an angular position between 30° and 60° measured from a vertical line passing through the impression roller axis and a line passing through the impression roller axis and the dam. The driven metering device roller may be an engraved roller and the metering device further comprises a doctor blade which has an edge facing a peripheral surface of the engraved metering device roller with a spacing between the edge and the peripheral surface of the engraved application roller set to a distance equal to the uniform thickness of coating material applied to the peripheral surface of the engraved metering device roller contained in a dam of coating material disposed between the edge and the peripheral surface of the engraved metering device roller during rotation of the roller; and wherein the peripheral surface of the engraved metering device roller transfers the uniform thickness of coating material to the peripheral surface of the application roller. The application roller is cylindrical and the peripheral surface of the application roller contacts the first face of the sheets or at least the gaps continually during coating of the first face of the sheets.

A method of coating the first face of sheets on which printing may be printed previously by a printer in accordance with the invention includes feeding the sheets to be coated from an infeed position along a coating zone to an outfeed position; contacting the first face of the sheets within the coating zone with a peripheral surface of an application roller to transfer a uniform thickness of coating material disposed on the peripheral surface to the first face; transferring a uniform thickness of the coating material from a metering device to the peripheral surface of the application roller to dispose the coating material on the peripheral surface of the application roller for transfer to the first face; contacting a second face of the sheets with a peripheral surface of an impression roller opposed to the peripheral surface of the application roller during coating of the first face with the peripheral surface of the impression roller contacting the peripheral surface of the application roller at least at gaps disposed between the sheets during feeding of the sheets along the coating zone which transfers the coating material to the peripheral surface of the impression roller; and removing the coating material from the peripheral surface of the impression roller prior to rotation of the peripheral surface of the impression roller to a point of contact with the second face of the sheets. The transfer of the uniform thickness of the coating material from the metering device to the application roller is produced by forming a dam of coating material between a doctor blade spaced by a distance from a rotating engraved metering device roller equal to the uniform thickness with the engraved metering device roller contacting the peripheral surface of the application roller. The sheets are fed from a bottom of a stack of sheets to be coated into the coating zone by contacting the second face of each sheet disposed at the bottom of the stack with a driven belt and the sheets are transferred along the coating zone with the driven belt. The dam of coating material is preferably located at an angular position between 30° and 60° measured from a vertical line passing through the impression roller axis and a line passing through the impression roller axis and the dam. The coated first face is cured at a curing station disposed at the outfeed position of the coating zone.

BEST MODE FOR CARRYING OUT THE INVENTION

Figure 1:
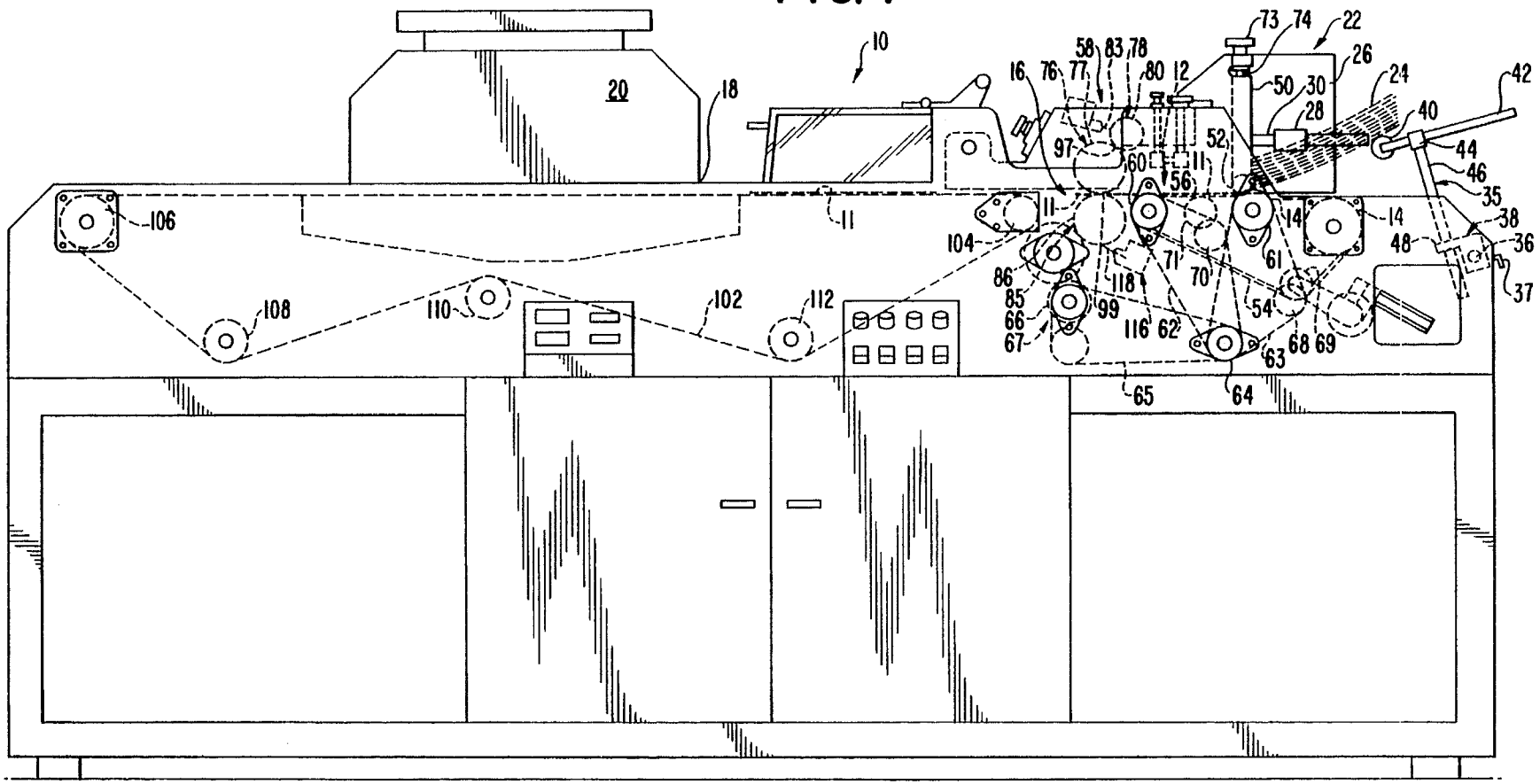
FIG. 1 is a schematic view of a coating system in accordance with the present invention.

FIG. 1 illustrates a general schematic view of a stand alone coating system 10 in accordance with the present invention. The coating system 10 functions to apply a coating material which may be either an aqueous or UV cured coating material of types well known in the printing industry. The coating system 10 coats a first face of sheets 11 on which printing may be printed previously by a printer not associated with the coating system which may be a conventional lithographic offset printing system. A feeding mechanism 12 feeds the sheets to be coated from an infeed position 14 through a coating zone 16 including a coating station 58. The coating zone extends from the infeed position 14 to an outfeed position 18 at which a curing station 20 is located which is preferably a station having an ultraviolet light source which may be used to chemically cure coating solutions which are cured by ultraviolet light or aqueous solutions which are cured by heat as a consequence of the significant amount of radiant energy which is generated by an ultraviolet light source. The infeed position 14 has a hopper 22 for containing a stack 24 of sheets 11 which are bottom fed from the hopper into the coating zone 16. The hopper 22 is comprised of a pair of spaced apart side members 26 which are adjustable in width to accommodate sheets of different width including sheets which do not have rectangular sides. The side members 26 are each attached by a cylinder 28 to a rod 30 to permit longitudinal adjustment of the side members on the rod 30 parallel to the coating zone 16. Each of the rods 30 are attached to a second clamp (not illustrated) which permits the width of the sides to be adjusted by clamping the second clamp to a slot (not illustrated) within the side wall of the system. The slot is orthogonal to the sidewall. The hopper 22 further includes a pair of sheet tilt mechanisms 35 which are pivotally clamped to pivot point 36 by a first part 37 of clamp 38 to permit adjustment of the angle of inclination of the individual sheet mechanisms. A roller 40 is disposed at the end of each member 42 which is clamped by a clamp 44 to an orthogonal member 46. The orthogonal member 46 is clamped by the second part 48 of clamp 38. The clamp 38 permits two adjustments to be made which are the angular inclination of the orthogonal member 46 and its vertical extension with the angular position being positioned by part 37 and vertical extension being adjusted by part 48 of the clamp 38. The adjustment of the clamping point of the member 42 in the clamp 44 adjusts the third component of movement of the sheet tilt mechanism 35. Appropriate adjustment of the clamps 38 and 44 permits adjustment of the vertical inclination of a stack of sheets to be coated on their top first surface by the coating system 10. The angle of inclination may be varied to facilitate the feeding of individual sheets of differing shapes, thickness and area. The inclination of the stack of sheets 24 from the vertical facilitates separation of individual sheets 11 for feeding through the feed zone 16.

The feeding mechanism 12 further includes an adjustable feed gate 50 through which the bottom sheet of the stack of sheets 24 passes during its movement from the infeed position 14 into the coating zone 16. The gap 52 extends from the bottom of the feed gap 50 to the top of one and preferably a plurality of belts 54 each having a top surface 56 on which a second bottom face of the individual sheet 11 rests during feeding to the coating station 58. The belt(s) 54 is rotated by rotary power applied to rollers 60 and 61 which are respectively driven by V-belts 62 and 63. Feed transfer pulley 64 drives V-belts 62 and 63 and is driven by V-belt 65. V-belt 65 is driven by feed power transfer pulley 66 which is the output of clutch 67. Clutch 67 is driven by a shaft extending through the system 10 to the back side where power is applied by a pulley attached to the shaft which is driven by a belt driven by a motor. Pulleys 68, 69 and 70 apply tension to the belts. The dual drive of the belt(s) 54 by the independently driven rollers 62 and 63 is to prevent slippage. The belt(s) 54 rotates around a series of rollers 60, 61, 70 and 71. The feed gap 52 is adjusted by turning knob 73 which rotates thread 74 to adjust the feed gate 50 vertically. The feed gap 52 is adjusted to accommodate the thickness of the individual sheets 11 whose top face is being coated so as to insure that only a single sheet at a time is fed along the belt(s) 54 toward the coating station 58.

Figure 2A:
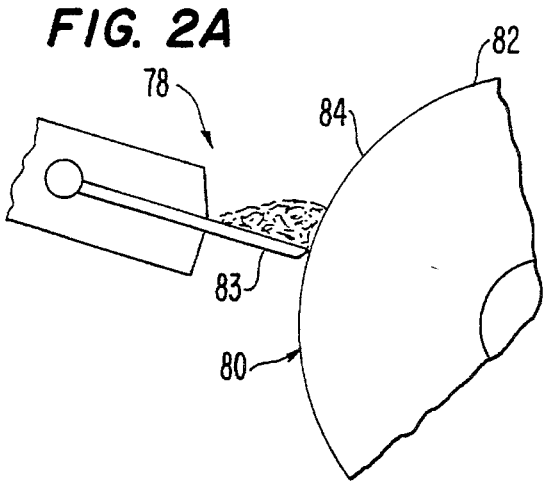
FIG. 2A illustrates an enlarged view of the metering device roller and doctor blade.

The coating station 58 is comprised of a driven application roller 76 which is disposed within the coating zone 16 and having a peripheral surface 77 which contacts the top face of the sheets 11 fed along the coating zone 16 through the coating station 58. A metering device 78 is disposed within the coating zone 16 and faces the peripheral surface 77 of the driven application roller 76. The metering device 78 transfers a uniform thickness of coating material, as described below in conjunction with FIGS. 2, 2A and 3, to the peripheral surface 77 of the driven application roller 76. The driven metering device roller 80 is part of the metering device 78 to which liquid coating material is supplied as described below in FIGS. 2 and 3. The preferred metering device roller 80 has an engraved surface 82 as described below in conjunction with FIG. 2A and is preferably identical to that disclosed in U.S. Pat. No. 4,685,414. Additionally, a doctor blade 83 having an edge facing the engraved peripheral surface 82 of the metering device roller 80 is set with a spacing between the edge and the engraved peripheral surface which sets a distance equal to the uniform thickness of coating material which is desired to be applied to the engraved peripheral surface 82 of the metering device roller 80. A dam of coating material is produced by the flow of coating material to the metering device 78 as described below which is disposed between the edge and the engraved peripheral surface 82 during rotation of the roller 80 with the engraved peripheral surface of the metering device roller transferring the uniform thickness of coating material to the peripheral surface 77 of the application roller 76. When the engraved peripheral surface 82 of the metering device roller 80 is engraved, fissures on the peripheral surface 82 of the metering device roller 80, retain the coating material. The doctor blade position, which is set when the peripheral surface 82 is engraved, determines the thickness of the coating material which is disposed on the peripheral surface 77 of the application roller 76. Alternatively, the position of the doctor blade 83 is adjustable to vary the spacing between the edge of the doctor blade and the peripheral surface 82 of the metering device roller 80 when the peripheral surface of the metering device roller does not contain the fissures which function as a retention mechanism. As illustrated, the peripheral surface 77 of the application roller 76 preferably has a rubber layer which deforms in response to pressure applied from metallic impression roller 85 at the nip 99 between the peripheral surface 86 of the impression roller 85. The impression roller 85 is vertically movable between a first coating position, as illustrated in FIG. 1 and a second vertically lower noncoating position (not illustrated). The application roller 76 and the metering roller 80 are manually adjustable vertically to determine spacing between the peripheral surface 77 of the application roller and the peripheral surface 86 of the impression roller 85. The manual adjustment of the vertical height of the axis of rotation of the application roller 76 and the metering roller 80 is made to accommodate varying thicknesses of sheets whose top surface is to be coated by the coating system of the present invention. The height adjustment assembly 87 is adjusted vertically and sets the height of the axis of rotation of the application roller 76 and metering roller 80 relative to the first position of the impression roller. Turning of knob 88 causes threads 89 to raise or lower the assembly 87. Threaded locating member 90 is set by lock nut 91 to set the vertical height of the assembly 87 by backing the assembly into contact with the end of member 90. The impression roller 85 is moved from its second position to its first position, as illustrated in FIG. 1 by a pneumatic actuator (not illustrated) that carries the impression roller 85 vertically upward.

As will be described in detail below in conjunction with FIG. 4, the metering device roller 80, application roller 76 and impression roller 85 are gear driven together by a gear driven transmission or, alternatively, the metering device roller may be independently driven and the application roller and impression roller may be gear driven together. A difference in speed between the peripheral surface 82 of the metering device roller 80 and the peripheral surface 77 of the application roller 76 may be used to control the amount of coating fluid which is coated by the metering device 78 onto the application roller 76. An independent motor drive is provided for the metering device roller 80 when it is required that the relative speed of the metering device roller is to be variable with respect to the speed of rotation of the peripheral surface 77 of the application roller 76 and the peripheral surface 86 of the impression roller 85.

It is necessary that the nip 97 between the metering device roller 80 and the application roller 76 and the nip 99 between the application roller and the impression roller 85 have one surface which is deformable. As illustrated in FIG. 1, the application roller 76 has a rubberized peripheral surface 77 which permits give between the peripheral surface of the driven application roller and the peripheral surface 86 of the impression roller 85. As illustrated, the peripheral surface 77 of the application roller 76 deforms during coating of the sheets and the peripheral surface 86 of the impression roller 85 does not deform during coating the sheets. The rubberized coating of the peripheral surface 77 of the application roller 76 produces deformation and the peripheral surface 86 of the impression roller 85 is metallic which prevents deformation.

Alternatively, the peripheral surface 77 of the application roller 76 does not deform during coating of the sheets and the peripheral surface 86 of the impression roller 85 deforms during coating of the sheets. The peripheral surface 77 of the application roller 76 is metallic and the peripheral surface 86 of the impression roller 85 is rubber when the impression roller is deformable. In this alternative embodiment, the peripheral surface 82 of the metering device roller 80 must also be deformable such as by coating with a rubberized coating to prevent a metal on metal contact at the nip 99 between the application and metering device rollers 76 and 80.

A second belt(s) 102 is driven over a series of rollers 104, 106, 108, 110 and 112 to propel the individual sheets after they have passed through the coating station 58 between the application roller and the impression roll nip 99. The second belt(s) 102 propels the coated sheets through the remainder of the coating zone 16 to the curing station 20.

The individual sheets 11 are fed through the coating zone 16 by the feeding mechanism 12, belt(s) 54 and belt(s) 102 such that gaps exist between the individual sheets 11 as they pass between the nip 99 of the application roller 76 and the impression roller 85. As a consequence of the width of the application roller 76 typically being wider than the sheets which are being fed between the nip 99, the peripheral surface 77 of the application roller 76 will undesirably touch the peripheral surface 86 of the impression roller 85 around the periphery of the individual sheets 11 as they pass between the nip 99 of the application roller 76 and the impression roller 85. The direct contact of the peripheral surface 77 with the peripheral surface 86 causes an undesirable transfer of coating material to the impression roller peripheral surface which must be removed prior to rotation of the impression roller peripheral surface to point of contact with the second face of the sheets in order to prevent undesirable coating of the second face of the sheets.

Figure 2:
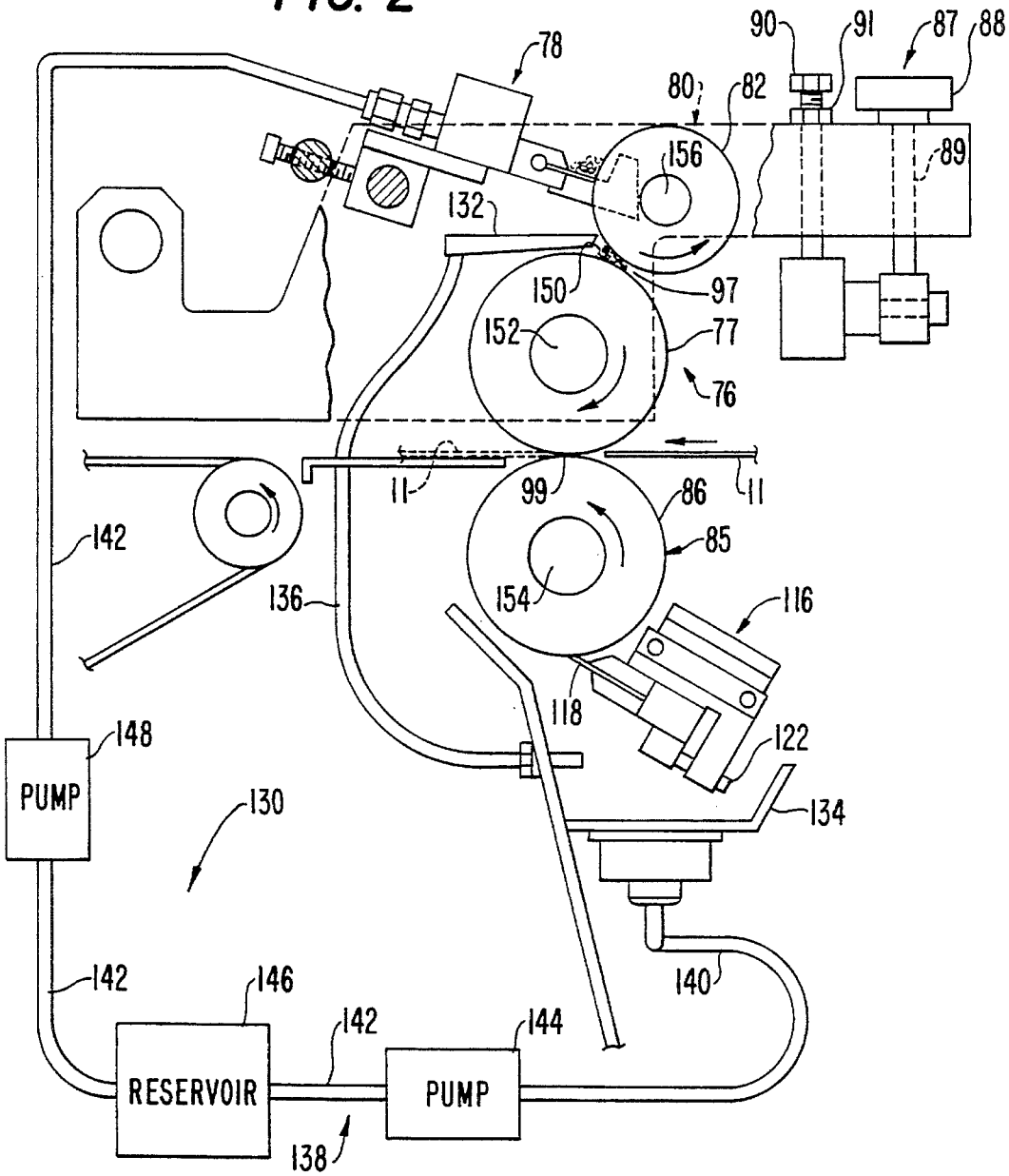
FIG. 2 illustrates a preferred position of the metering device roller at a point of contact with the application roller which minimizes spillage of coating material onto parts of the coating system disposed below the driven metering device roller.
Figure 3:
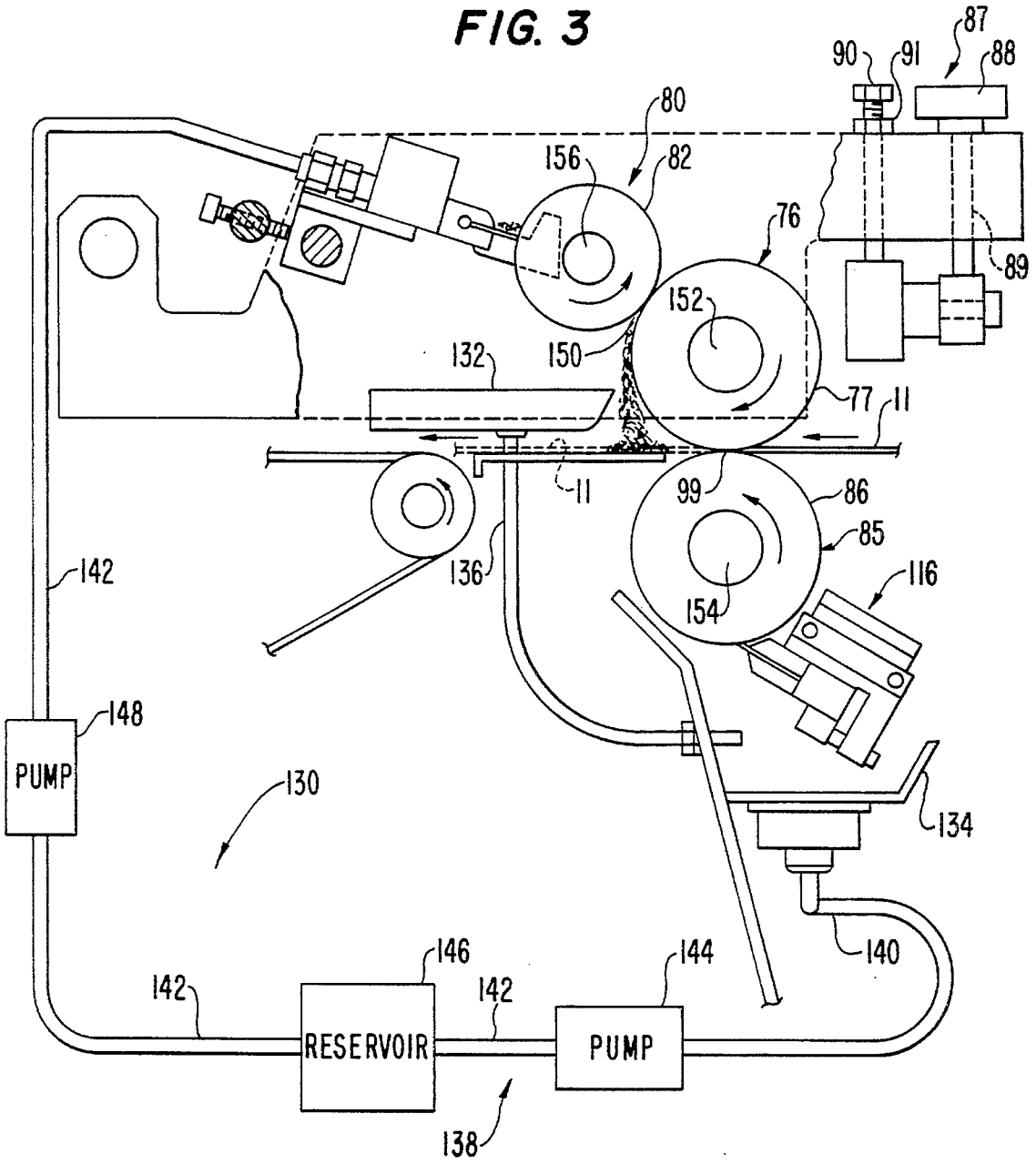
FIG. 3 illustrates one possible angular orientation of the driven metering device roller at a point of contact with the application roller.

A coating material removing mechanism 116 partially illustrated in FIG. 1 and in detail in FIGS. 2 and 3 contacts the impression roller peripheral surface 86 to remove coating material from the impression roller peripheral surface 80 caused by direct surface contact with the peripheral surface 77 of the application roller 76 prior to rotation of the impression roller peripheral surface up to the point of contact with the second face of the individual sheets 11. If the coating material removing mechanism 116 was not present, operation of the present invention would typically result in undesirable coating of the second face of the individual sheets. Moreover, the use of the impression roller 85 by the present invention to apply pressure during coating by the peripheral surface 77 of the application roller 76 is a much less expensive mechanism than utilization of coating mechanisms which are add-ons to conventional lithographic offset printing systems as described above. The coating material removing mechanism 116 has a doctor blade 118 which may be adjusted to ride on the peripheral surface 86 of the impression roller 85 by adjustment of threaded member 122 and an angular adjustment mechanism which permits rotation of the doctor blade 118 about a pivot point by adjustment of threaded member.

A coating material recirculation system 130 is illustrated in FIGS. 2 and 3. The coating material recirculation system 130 has a first pan 132 disposed below the metering device roller 80 for catching any coating material flowing from the metering device roller during coating of the first face of the sheets. A second pan 134 is disposed below the coating material removing mechanism 116 for catching any coating material flowing from the impression roller 85 and the coating material removing mechanism 92. A drain 136 drains coating material collecting in the first pan 132 into the second pan 134. A flow path 138 connects a drain 140 in the second pan 134 to the metering device roller 80 where coating material is distributed preferably in accordance with the description of U.S. Pat. No. 4,685,414. The flow path 138 is comprised of a plurality of conduit sections 142, at least one pump with preferably a first pump 144 for pumping fluid flowing from the drain 140 into a reservoir 146 and a second pump 148 pumping coating material flowing from the reservoir 146 to the application roller 80. As stated above, the coating material may be an aqueous solution or a UV curable solution which is cured by absorption of ultraviolet light with the present invention not being limited to any particular type of coating material. Moreover, the coating material may further be materials such as adhesives for the attachment of packaging material such as blister packs.

FIG. 2 illustrates the preferred orientation of the dam 150 of coating material, which collects between the nip 97 of the peripheral surface 82 of the metering device roller 80 and the peripheral surface 77 of the application roller 76, which is disposed closer to the infeed position 14 than an axis of rotation 152 of the application roller 76. The dam of coating material 150 forms at the opposed peripheral surfaces 77 and 82 when the driven application roller 76 and driven metering device roller 80 are rotating in opposite directions which conveys the coating material toward the infeed position 14 during coating of the first face of the sheet. The dam 150 is preferably located at an angular position between 30° and 60° measured from a vertical line passing through the axis 154 of the impression roller 85 and a line passing through the impression roller axis 152 and the dam 150.

The advantage of the foregoing location of the dam 150, as illustrated in FIG. 2, is apparent when compared to a location of the dam 150 as illustrated in FIG. 3. In FIG. 3, the axis of rotation 156 of the metering device roller 80 is located farther from the infeed position 14 than the axis of rotation 152 of the application roller 76. In this situation, the dam of material 150, as a consequence of gravitational effects, may drip down and coat parts of the coating system 10 disposed below the dam which does not occur with the location of the dam 150 as illustrated in FIGS. 2. It should be understood that the present invention is operative with a location of the dam 150 where the axis of rotation 156 of the metering device roller 80 is disposed farther from the infeed position 14 than the axis of rotation 132 of the application roller 76 but this is less desirable because of the potential of the aforementioned spillage onto parts of the coating system below the dam 150. With the location of the dam 150 as described in conjunction with FIG. 3, the potential for spillage 157 increases as the viscosity of the coating material decreases.

It should be understood that the application roller 76 of the present invention is cylindrical which causes the entire surface of the application roller to function to transfer coating material to the top face of the sheets 11 being coating. This is contrasted with the prior art described above wherein only the raised portion of a blanket cylinder transfers coating material. As a result, the entire peripheral surface 77 of the application roller 76 is in rolling contact with either the top face of the sheets 11 being coated, the top face of the sheets and the portion of the impression roller peripheral surface 85 extending beyond the width of the sheet or the entire width of the impression roller when the nip 99 is between sheets.

Figure 4:
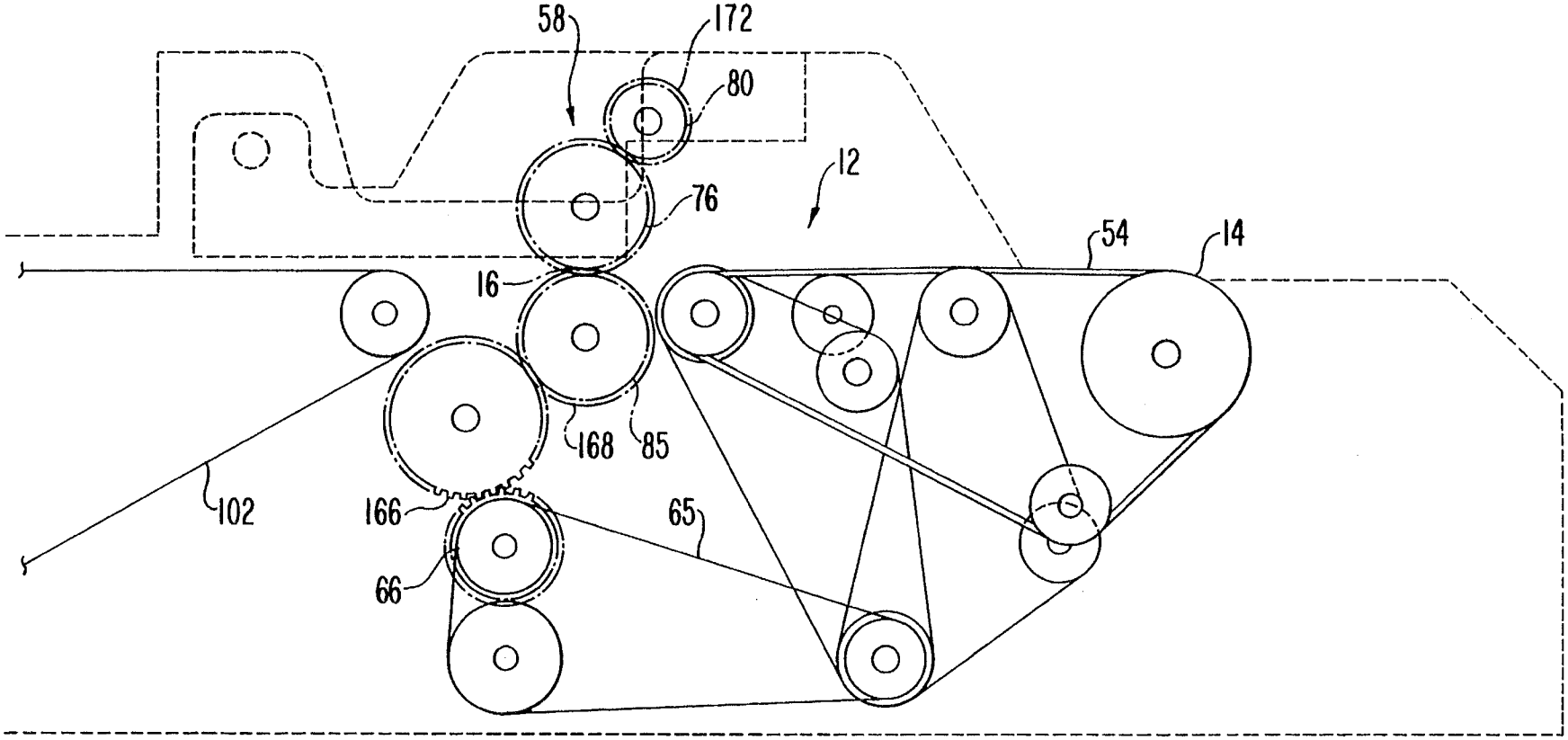
FIG. 4 illustrates the drive mechanism for the various rollers and belts of the coating system of the present invention.

FIG. 4 illustrates the drive mechanism for the belts 54 and 102, the application roller 76, metering device roller 80 and impression roller 85. Preferably, the overall power for driving the aforementioned rollers is supplied by a belt drive from a primer mover to a pulley which drives a common gear train driving each of the aforementioned rollers. As explained above, the application roller 76 and the metering roller 80 are vertically movable to permit positioning for coating and further to permit adjustment for sheets of varying thickness. The depth of the teeth of the gear train between the driven application roller 76 and the driven impression roller 85 is machined to accommodate the aforementioned vertical adjustment while providing direct drive. The particular drive ratios are a matter of design choice but a 1:1 ratio is employed between the application roller 76 and the impression roller 85 as illustrated in FIG. 1. Furthermore, as described above, the metering device roller 80 may be independently driven by a prime mover (not illustrated). As illustrated, the metering device roller 80 is gear driven from the application roller 76 with a gear ratio of 1.4:1. The gear drive for supplying power to the impression roller 85 is 1.14:1 with power transferred from gear 166 to gear drive 168 associated with the impression roller 84. The gear drive of the impression roller 85 in turn drives the gear 170 associated with the application roller 76. The gear associated with the impression roller 76 in turn drives the gear 172 associated with metering device roller 80.

The feeding mechanism 12 functions to feed the sheets to be coated from the infeed position 14 to the outfeed position 18; the application roller 76 contacts the first face of the sheets 11 at the coating station 58 within the coating zone 16 to transfer a uniform thickness of coating material disposed on the peripheral surface 77 to the top face; the metering device roller 80 functions to transfer a uniform thickness of coating material from the peripheral surface 82 to the peripheral surface 77 of the application roller 76 to dispose the coating material on the peripheral surface of the application roller for transfer to the first face; the peripheral surface 86 of the impression roller 85 contacts the second face of the sheets 11 during coating of the first face with the peripheral surface 86 of the impression roller 85 contacting the peripheral surface 77 of the application roller 76 at least at gaps disposed between the sheets during feeding of the sheets along the coating zone 16 at the coating station 58 which transfers the coating material to the peripheral surface of the impression roller which is removed by the coating material removing mechanism 116 from the peripheral surface 86 prior to rotation of the peripheral surface of the impression roller to the nip point 99 of contact with the second face of the sheets. The transfer of the uniform thickness of the coating material from the metering device roller 80 to the application roller 76 is produced by forming a dam of coating material between the doctor blade 83 spaced by distance from a rotating metering device roller equal to the uniform thickness with the metering device roller 80 of the metering device 78 contacting the peripheral surface 77 of the application roller 76. The sheets 11 to be coated are fed from the bottom of the stack into the coating zone 16 by contacting the second face of each sheet disposed at a bottom of the stack with the driven belt(s) 54 with the driven belt transferring the sheets along the coating zone 16 with the driven belt. The dam 150 of coating material is preferably located at an angular position between 30° and 60° measured from a vertical line passing through the impression roller axis 154 and a line passing through the impression roller axis and the dam 150. After coating the first face, the coated first face is cured at the curing station 20 disposed at the outfeed position 18 of the coating zone 16.

While the present invention has been described in terms of its preferred embodiments, it should be understood that numerous modifications may be made thereto without departing from the spirit and scope of the invention as defined in the appended claims. It is intended that all such modifications fall within the scope of the appended claims.

I claim:

1. A stand alone coating system for coating a first face of sheets on which printing may be printed previously by a printer not associated with the coating system comprising:

a feeding mechanism for feeding the sheets to be coated from an infeed position to a coating zone at which the sheets are coated to an outfeed position;

a driven application roller, disposed within the coating zone and having a peripheral surface which contacts the first face of the sheets fed along the coating zone, for transferring coating material disposed on the peripheral surface to the first face;

a metering device, disposed within the coating zone and facing the peripheral surface of the application roller, for transferring a uniform thickness of coating material to the peripheral surface of the application roller;

a driven impression roller, disposed within the coating zone and having a peripheral surface opposed to the peripheral surface of the application roller, which contacts a second face of the sheets opposed to the first face and which contacts the peripheral surface of the application roller at least at gaps disposed between the sheets during feeding of the sheets along the coating zone which transfers the coating material to the peripheral surface of the impression roller;

a coating material removing mechanism, contacting the peripheral surface of the impression roller, for removing coating material from the peripheral surface of the impression roller to prevent transfer of the coating material to the second face of the sheets; and a coating material recirculation system for catching any coating material dropping from the metering device during coating of the first face of the sheets and for catching any coating material dropping from the coating material removing mechanism and for recirculating the coating material caught from the metering device and coating material removing mechanism to the metering device.

2. A coating system in accordance with claim 1 wherein the metering device comprises:

a metering device roller; and a doctor blade which has an edge facing a peripheral surface of the metering device roller with a spacing between the edge and the peripheral surface of the metering device roller set to a distance equal to the uniform thickness of coating material applied to the peripheral surface of the metering device roller from a dam of coating material disposed between the edge and the peripheral surface of the metering device roller during rotation of the roller; and wherein the peripheral surface of the metering device roller transfers the uniform thickness of coating material to the peripheral surface of the application roller.

3. A coating system in accordance with claim 1 wherein:

the doctor blade is adjustable to vary the setting of the uniform thickness.

4. A coating system in accordance with claim 1 wherein:

the metering device roller is engraved.

5. A stand alone coating system in accordance with claim 1 wherein:

the peripheral surface of the application roller deforms during coating of the sheets and the peripheral surface of the impression roller does not deform during coating of the sheets.

6. A stand alone coating system in accordance with claim 1 wherein:

the peripheral surface of the application roller is rubber and the peripheral surface of the impression roller is metallic.

7. A stand alone printer in accordance with claim 1 wherein:

the peripheral surface of the application roller does not deform during coating of the sheets and the peripheral surface of the impression roller deforms during coating of the sheets.

8. A stand alone printer in accordance with claim 1 wherein:

the peripheral surface of the application roller is metallic and the peripheral surface of the impression roller is rubber.

9. A stand alone coating system in accordance with claim 1 further comprising:

a feeder disposed at the infeed position for feeding individual sheets from a bottom of a stack of sheets to be coated to the coating zone, the feeder having a first driven belt with a top surface which contacts the second face of the sheets after the sheets are fed from the bottom of the stack and which conveys the sheets toward and past the application roller and impression roller.

10. A stand alone coating system for coating a first face of sheets on which printing may be printed previously by a printer not associated with the coating system comprising:

a feeding mechanism for feeding the sheets to be coated from an infeed position along a coating zone at which the sheets are coated to an outfeed position;

a driven application roller, disposed within the coating zone and having a peripheral surface which contacts the first face of the sheets fed along the coating zone, for transferring coating material disposed on the peripheral surface to the first face;

a metering device, disposed within the coating zone and having a driven metering device roller facing the peripheral surface of the application roller, for transferring a uniform thickness of coating material to the peripheral surface of the application roller from the driven roller;

a driven impression roller, disposed within the coating zone and having a peripheral surface opposed to the peripheral surface of the application roller, which contacts a second face of the sheets opposed to the first face and which contacts the peripheral surface of the application roller at least at gaps disposed between sheets during feeding of the sheets along the coating zone to transfer coating material to the peripheral surface of the impression roller;

a coating material removing mechanism, contacting the peripheral surface of the impression roller, for removing coating material from the peripheral surface of the impression roller to prevent transfer of the coating material to the second face of the sheets; and a coating material recirculation system for catching any coating material dropping from the metering device roller during coating of the first surface of the sheets and for catching any coating material dropping from the coating material removing mechanism and for recirculating the coating material caught from the metering device roller and the coating material removing mechanism to the metering device; and wherein an axis of rotation of the driven metering device roller of the metering device is disposed closer to the infeed position than an axis of rotation of the application roller causing a dam of coating material to form at opposed peripheral surfaces of the driven metering device roller and the application roller when the driven metering device roller and application roller are rotating in opposite directions which conveys the coating material toward the infeed position forming the dam during coating of the first face of the sheet.

11. A stand alone coating system in accordance with claim 10 wherein:

the dam of coating material is located at an angular position between 30° and 60° measured from a vertical line passing through the impression roller axis and another line passing through the impression roller axis and the dam.

12. A stand alone coating system in accordance with claim 10 wherein:

the driven metering device roller is an engraved roller; and the metering device further comprises a doctor blade which has an edge facing a peripheral surface of the engraved metering device roller with a spacing between the edge and the peripheral surface of the engraved metering device roller set to a distance equal to the uniform thickness of coating material applied to the peripheral surface of the engraved metering device roller contained in the dam of coating material disposed between the edge and the peripheral surface of the engraved metering device roller during rotation of the roller; and wherein the peripheral surface of the engraved metering device roller transfers the uniform thickness of coating material to the peripheral surface of the application roller.

13. A stand alone coating system in accordance with claim 10 wherein:

the application roller is cylindrical and the peripheral surface of the application roller contacts the first face of the sheets or at least the gaps continually during coating of the first face of the sheets.

14. A stand alone coating system in accordance with claim 11 wherein:

the application roller is cylindrical and the peripheral surface of the application roller contacts the first face of the sheets or at least the gaps continually during coating of the first face of the sheets.

15. A stand alone coating system in accordance with claim 12 wherein:

the application roller is cylindrical and the peripheral surface of the application roller contacts the first face of the sheets or at least the gaps continually during coating of the first face of the sheets.

16. A stand alone coating system for coating a first face of sheets on which printing may be printed previously by a printer not associated with the coating system comprising:

a feeding mechanism for feeding the sheets to be coated from an infeed position to a coating zone at which the sheets are coated to an outfeed position;

a driven application roller, disposed within the coating zone and having a peripheral surface which contacts the first face of the sheets fed along the coating zone, for transferring coating material disposed on the peripheral surface to the first face;

a metering device, disposed within the coating zone and facing the peripheral surface of the application roller, for transferring a uniform thickness of coating material to the peripheral surface of the application roller;

a driven impression roller, disposed within the coating zone and having a peripheral surface opposed to the peripheral surface of the application roller, which contacts a second face of the sheets opposed to the first face and which contacts the peripheral surface of the application roller at least at gaps disposed between the sheets during feeding of the sheets along the coating zone which transfers the coating material to the peripheral surface of the impression roller;

a coating material removing mechanism, contacting the peripheral surface of the impression roller, for removing coating material from the peripheral surface of the impression roller to prevent transfer of the coating material to the second face of the sheets; and a coating material recirculation system having a first pan disposed below the metering device for catching any coating material dropping from the metering device during coating of the first face of the sheets, a second pan disposed below the coating material removing mechanism for catching any coating material dropping from the impression roller and the coating material removing mechanism, a drain for draining coating material collecting in the first pan into the second pan, a flow path connecting a drain in the second pan to the metering device, and at least one pump for pumping the coating material through the flow path from the drain of the second pan to the metering device.

17. A method of coating a first face of sheets on which printing may be printed previously by a printer comprising:

feeding the sheets to be coated from an infeed position along a coating zone to an outfeed position;

contacting the first face of the sheets within the coating zone with a peripheral surface of an application roller to transfer a uniform thickness of coating material disposed on the peripheral surface to the first face;

transferring a uniform thickness of the coating material from a metering device to the peripheral surface of the application roller to dispose the coating material on the peripheral surface of the application roller for transfer to the first face;

contacting a second face of the sheets with a peripheral surface of an impression roller opposed to the peripheral surface of the application roller during coating of the first face with the peripheral surface of the impression roller contacting the peripheral surface of the application roller at least at gaps disposed between the sheets during feeding of the sheets along the coating zone which transfers the coating material to the peripheral surface of the impression roller;

removing the coating material from the peripheral surface of the impression roller with a coating material removing mechanism prior to rotation of the peripheral surface of the impression roller to a point of contact with the second face of the sheets; and catching any coating material dropping from the metering device during coating of the first face of the sheets and any coating material dropping from the coating material removing mechanism and recirculating the coating caught from the metering mechanism and coating material removing mechanism to the metering device.

18. A method in accordance with claim 17 wherein:

the transfer of the uniform thickness of the coating material from the metering device to the application roller is produced by forming a dam of coating material between a doctor blade spaced by a distance from a rotating metering device roller with the thickness being equal to the uniform thickness with the metering device roller of the metering device contacting the peripheral surface of the application roller.

19. A method in accordance with claim 17 further comprising:

feeding sheets from a bottom of a stack of sheets to be coated into the coating zone by contacting the second face of each sheet disposed at a bottom of the stack with a driven belt; and transferring the sheets along the coating zone with the driven belt.

20. A method in accordance with claim 17 wherein:

the dam of coating material is located at an angular position between 30° and 60° measured from a vertical line passing through the impression roller axis and a line passing through the impression roller axis and the dam.

* * * * *